US009099262B2

(12) United States Patent
Satou

(10) Patent No.: US 9,099,262 B2
(45) Date of Patent: Aug. 4, 2015

(54) VEHICLE PUSH BUTTON SWITCH

(71) Applicant: KABUSHIKI KAISHA HONDA LOCK, Miyazaki-shi, Miyazaki (JP)

(72) Inventor: Yuuichi Satou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 56 days.

(21) Appl. No.: 13/971,080

(22) Filed: Aug. 20, 2013

(65) Prior Publication Data

US 2014/0061016 A1 Mar. 6, 2014

(30) Foreign Application Priority Data

Aug. 30, 2012 (JP) ..... 2012-190215

(51) Int. Cl.
*H01H 3/00* (2006.01)
*H01H 13/00* (2006.01)
(Continued)

(52) U.S. Cl.
CPC ..... *H01H 13/10* (2013.01); *E05B 81/76* (2013.01); *H01H 13/06* (2013.01); *H01H 13/14* (2013.01); *H01H 13/063* (2013.01)

(58) Field of Classification Search
CPC ... H01H 13/00; H01H 3/00; H01H 2231/026; H01H 2231/01; H01H 2223/03; H01H 2223/034; H01H 2223/00; H01H 2221/00; H01H 2201/00; H01H 2003/161; H01H 2003/12; H01H 13/04; H01H 13/50; H01H 9/04; H01H 3/02; H01H 3/12
USPC ..... 200/302.1–302.3, 303, 50.1, 406, 468, 200/511, 513, 522, 565, 293, 293.1, 295, 200/318, 329, 333, 339, 338, 341, 345, 279
See application file for complete search history.

(56) References Cited

U.S. PATENT DOCUMENTS 4,074,112 A * 2/1978 Runft ..... 200/279
6,626,473 B1 * 9/2003 Klein et al. ..... 292/347
8,237,072 B2 8/2012 Kubota

FOREIGN PATENT DOCUMENTS

JP 2000113764 A 4/2000
JP 2003-197061 A 7/2003
(Continued)

OTHER PUBLICATIONS

Official Communications dated Nov. 5, 2014 issued in the corresponding Japanese Patent Application No. 2012-190215.
(Continued)

*Primary Examiner* — Edwin A. Leon
*Assistant Examiner* — Anthony R. Jimenez
(74) *Attorney, Agent, or Firm* — Carrier Blackman & Associates, P.C.; Joseph P. Carrier; William D. Blackman

(57) ABSTRACT

In a vehicle push button switch, movement of a push button is guided by multiple guide portions and backlash of the push button during a push operation thereof is thereby prevented, and operations of the push button are not hindered even when water attached to an outer surface of a bar-shaped portion of the push button freezes. The case is provided with a plurality of guide portions spaced away from each other in a peripheral direction of the bar-shaped portion to guide a plurality of sections of the bar-shaped portion that are located in the peripheral direction, and an ice scraping rib protrudes from an outer surface of the bar-shaped portion. The ice scraping rib scraps away a frozen ice portion formed by freezing of water attached to the outer surface of the bar-shaped portion between the plurality of guide portions, in response to movement of the bar-shaped portion.

12 Claims, 9 Drawing Sheets

(51) Int. Cl.

| | |
|---|---|
| ***H01H 13/10*** | (2006.01) |
| ***E05B 81/76*** | (2014.01) |
| ***H01H 13/06*** | (2006.01) |
| ***H01H 13/14*** | (2006.01) |

(56) References Cited

FOREIGN PATENT DOCUMENTS

| | | | |
|---|---|---|---|
| JP | 2003-257274 | A | 9/2003 |
| JP | 2010-080234 | A | 4/2010 |
| JP | 2010135245 | A | 6/2010 |
| JP | 2010-198843 | A | 9/2010 |

OTHER PUBLICATIONS

Official Communications dated Apr. 3, 2015 related to corresponding Chinese Patent Application 201310379804.2.

* cited by examiner

VEHICLE PUSH BUTTON SWITCH

BACKGROUND OF THE INVENTION

1. Field of the Invention

The present invention relates to a vehicle push button switch comprising: a push button including a linearly-extending bar-shaped portion and a push operation portion which is provided at an outer end of the bar-shaped portion to protrude outward from the bar-shaped portion and to be operable by being pushed from outside of a vehicle; a case fixed to a vehicle body or a lid openably and closably attached to the vehicle body, the case having a guide portion for guiding a linear movement of the push button; and a switch housed in the case such that a switching state of the switch is changed in response to a push operation of the push button.

2. Description of the Related Art

Japanese Patent Application Laid-open No. 2010-80234 has already made known a technique in which a case of a push button switch for releasing a latch of a trunk lid of a vehicle is formed of a rear spoiler provided on the trunk lid. In this technique, if the push button switch is disposed in a thick portion of the rear spoiler, the length of a push button in a moving direction thereof has to be set relatively long for a push operation portion of the push button to face the outside of the vehicle. However, in this case, support of the push button is unstable and backlash in the push operation of the push button is large, thereby causing deterioration in operability.

To solve such a problem, Japanese Patent Application Laid-open No. 2003-197061 has made known a technique in which a guide portion prevents backlash of a long and unstable push button.

SUMMARY OF THE INVENTION

However, when the configuration disclosed in Japanese Patent Application Laid-open No. 2003-197061 is applied as it is to the push button switch in which a push operation portion protruding outward from a linearly-extending bar-shaped portion is provided at an outer end of the bar-shaped portion, the guide portion needs to be formed in a tubular shape surrounding the bar-shaped portion of the push button switch. However, there is no need for the guide portion to be completely tubular to guide the movement of the push button. From the view point of weight reduction, the push button switch may be configured such that multiple guide portions spaced away from each other in a peripheral direction of the bar-shaped portion guide multiple sections of the bar-shaped portion that are located in the peripheral direction. However, when the push button switch is configured such that the bar-shaped portion of the push button is guided by the multiple guide portions spaced away from each other in the peripheral direction, in an environment in which the push button is exposed to rain water and the like or in a high-humidity environment, water attached to an outer surface of the bar-shaped portion in the push button may freeze due to drop in temperature of the surroundings and thereby hinder operations of the push button.

The present invention has been made in view of the circumstances described above and an object thereof is to provide a vehicle push button switch in which movement of a push button is guided by multiple guide portions spaced away from each other in a peripheral direction and backlash of the push button during a push operation thereof is thereby prevented with the weight of the vehicle push button switch reduced and in which operations of the push button are not hindered even when water attached to an outer surface of a bar-shaped portion of the push button freezes.

In order to achieve the object, according to a first aspect of the present invention, there is provided a vehicle push button switch comprising: a push button including a linearly-extending bar-shaped portion and a push operation portion which is provided at an outer end of the bar-shaped portion to protrude outward from the bar-shaped portion and to be operable by being pushed from outside of a vehicle; a case fixed to a vehicle body or a lid openably and closably attached to the vehicle body, the case having a guide portion for guiding a linear movement of the push button; and a switch housed in the case such that a switching state of the switch is changed in response to a push operation of the push button, wherein as said guide portion, the case is provided with a plurality of guide portions spaced away from each other in a peripheral direction of the bar-shaped portion to guide a plurality of sections of the bar-shaped portion that are located in the peripheral direction, and an ice scraping rib protrudes from an outer surface of the bar-shaped portion, the ice scraping rib capable of scraping away a frozen ice portion, which is formed by freezing of water attached to the outer surface of the bar-shaped portion between the plurality of guide portions, in response to movement of the bar-shaped portion following the push operation of the push button.

According to the first aspect of the present invention, since the ice scraping rib protrudes from the outer surface of the push button and the frozen ice portion which is formed on the outer surface of the bar-shaped portion of the push button between the guide portions spaced away from each other in the peripheral direction can be removed by the ice scraping rib in the push operation of the push button, the push operation of the push button is not hindered even when the frozen ice portion is formed on the outer surface of the bar-shaped portion.

According to a second aspect of the present invention, in addition to the first feature, an inclined surface is formed at least in a front end portion of the ice scraping rib in a moving direction of the push button in the push operation, the inclined surface being inclined in such a way that a protruding amount thereof from the bar-shaped portion becomes smaller toward a front side in the moving direction.

According to the second aspect of the present invention, the frozen ice portion can be more effectively removed by the inclined surface formed at least in the front end portion of the ice scraping rib.

The above and other objects, characteristics and advantages of the present invention will be clear from detailed descriptions of the preferred embodiments which will be provided below while referring to the attached drawings.

DESCRIPTION OF THE PREFERRED EMBODIMENT

A description is given below of an embodiment of the present invention with reference to the attached drawings of FIGS. 1 to 9. First, in FIGS. 1 and 2, a trunk lid 11 is openably and closably attached to a rear portion of a vehicle body B of a passenger vehicle V, a rear spoiler 12 is attached to an upper surface of a rear portion of the trunk lid 11, and a push button switch 13 for transmitting an unlatching signal for releasing a latched state of the trunk lid 11 is disposed in the rear spoiler 12. Specifically, in a case where the push button switch 13 is pressed in the latched state of the closed trunk lid 11, two-way communication is performed between the vehicle and a portable device carried by a vehicle driver and the latched state of the trunk lid 11 is released when the portable device is confirmed to be a regular portable device through code matching.

Figure 1:
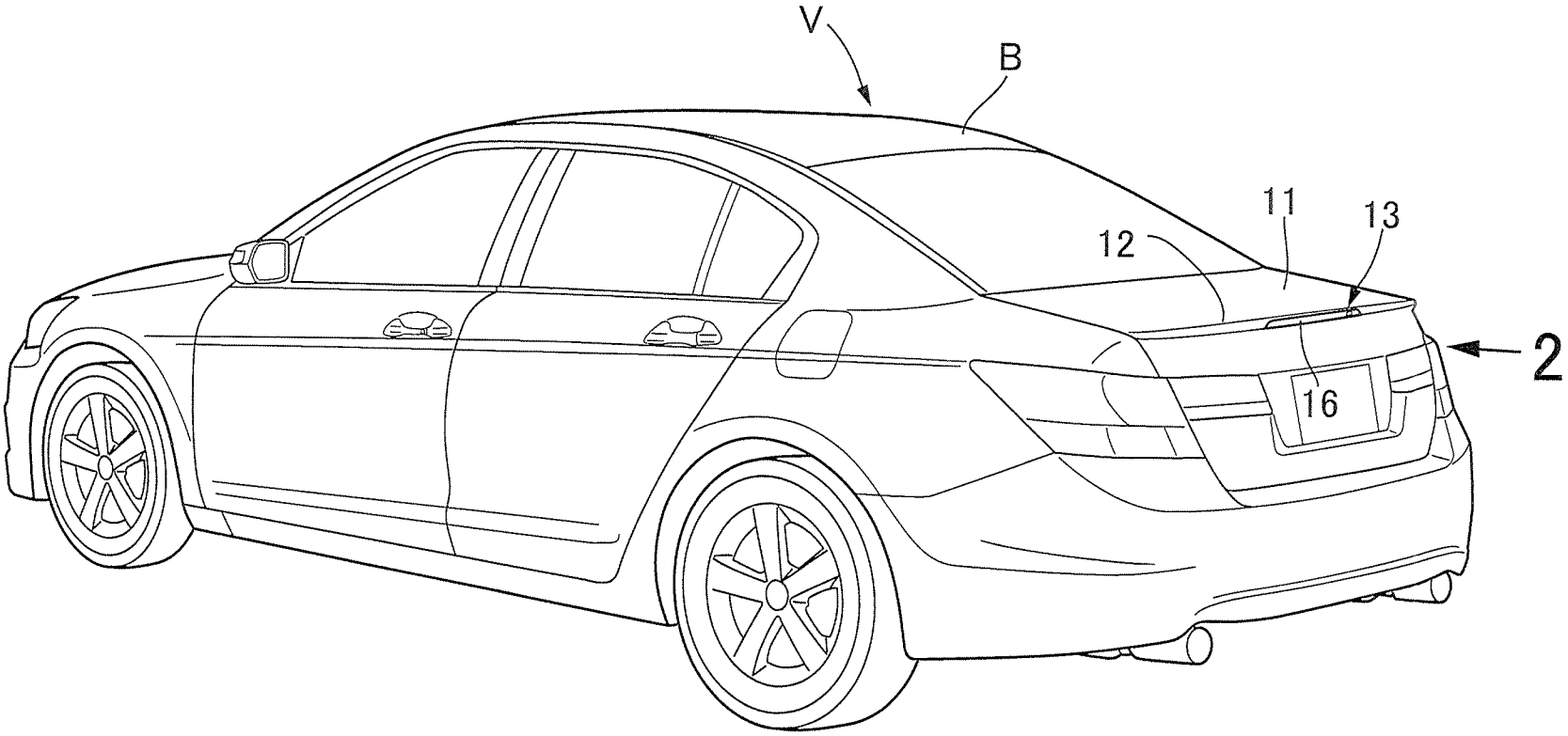
FIG. 1 is a perspective view of a passenger vehicle as viewed from a rear side.
Figure 2:
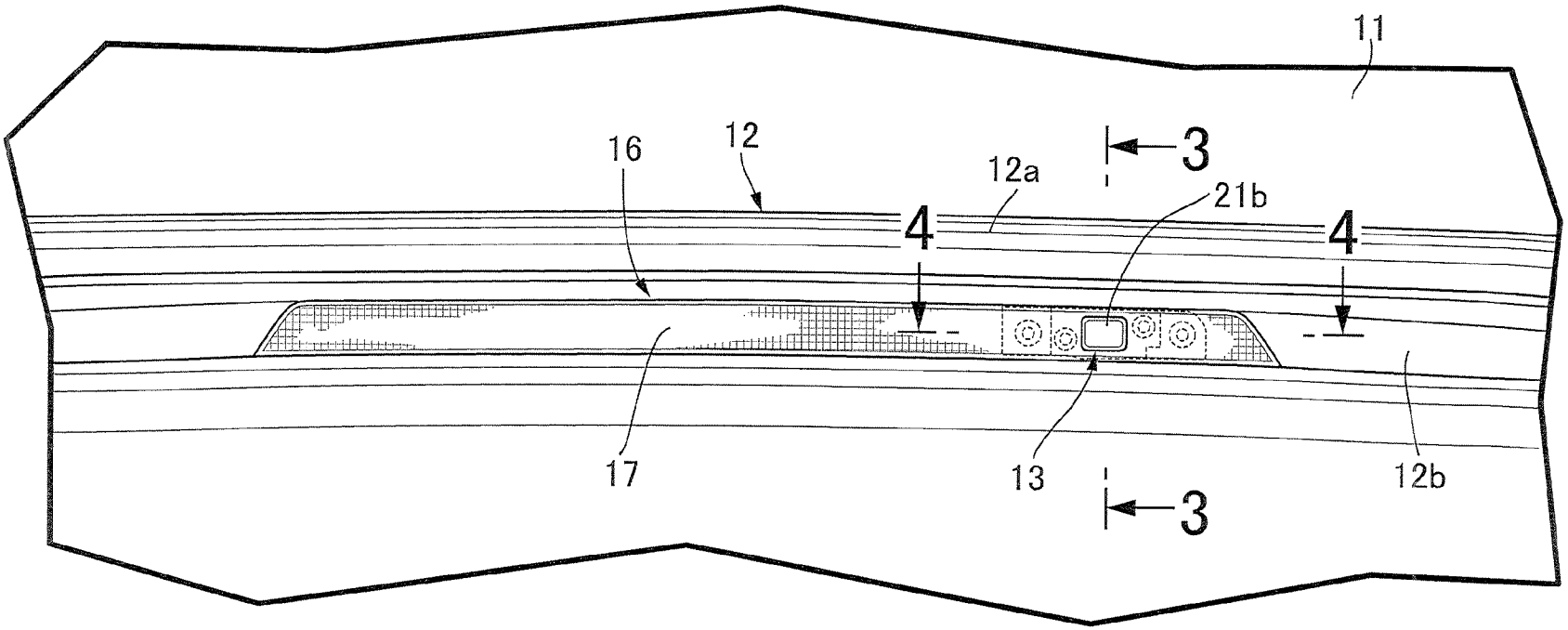
FIG. 2 is a view in the direction of the arrow 2 in FIG. 1.
Figure 3:
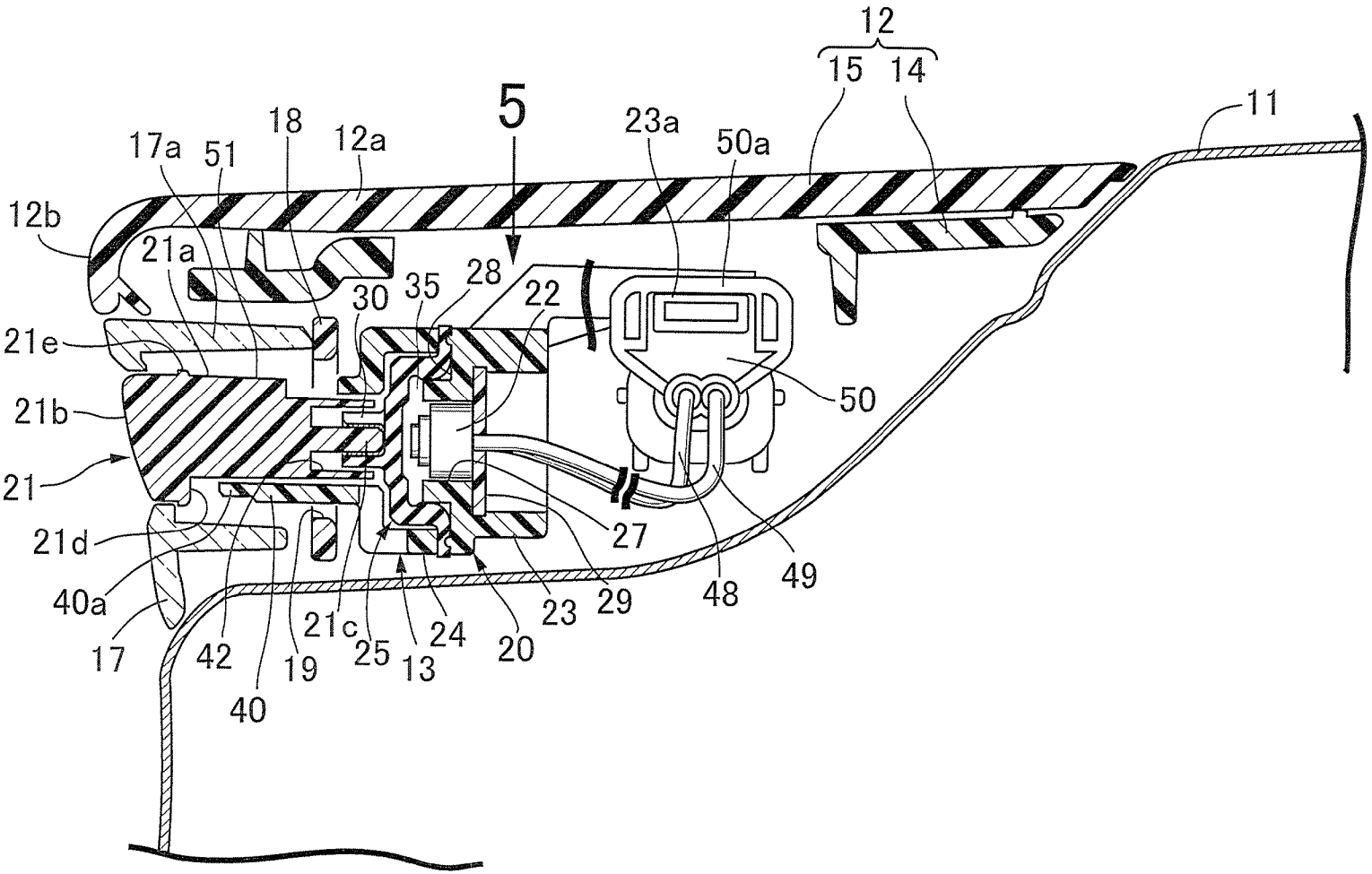
FIG. 3 is a sectional view taken along the line 3-3 in FIG. 2.

Referring also to FIG. 3, the rear spoiler 12 is formed by joining an inner spoiler 14 made of a synthetic resin with high stiffness and an outer spoiler 15 made of a painted synthetic resin to each other in such a way that the inner spoiler 14 is covered with the outer spoiler 15. A horizontal cross-sectional shape of the rear spoiler 12 includes a horizontal portion 12*a* substantially horizontal in the closed state of the trunk lid 11 and a vertical portion 12*b* extending downward from a rear end of the horizontal portion 12*a*.

A brake lamp 16 is disposed in a center portion of the vertical portion 12*b* in the rear spoiler 12 in a vehicle width direction. A lens 17 forming part of the brake lamp 16 is made of a translucent synthetic resin and is supported by an attachment member 18 fixed to the inner spoiler 14 of the rear spoiler 12.

The push button switch 13 is disposed in a right portion of the brake lamp 16 in the vehicle width direction, a tube portion 17*a* having a rectangular horizontal cross section and extending in a front-rear direction with a rear end coming in contact with the attachment member 18 is integrally formed in the lens 17 of the brake lamp 16, and a rectangular through hole 19 corresponding to the rear end of the tube portion 17*a* is provided in the attachment member 18.

The push button switch 13 includes a case 20 fixed to the trunk lid 11, a push button 21 operable by being pushed from the outside of the vehicle, and a tact switch 22 supported by the case 20 such that a switching state is changed in response to a push operation of the push button 21. The push button 21 is housed inside the tube portion 17*a* of the lens to be capable of linearly moving in a longitudinal direction of the tube portion 17*a*.

Figure 4:
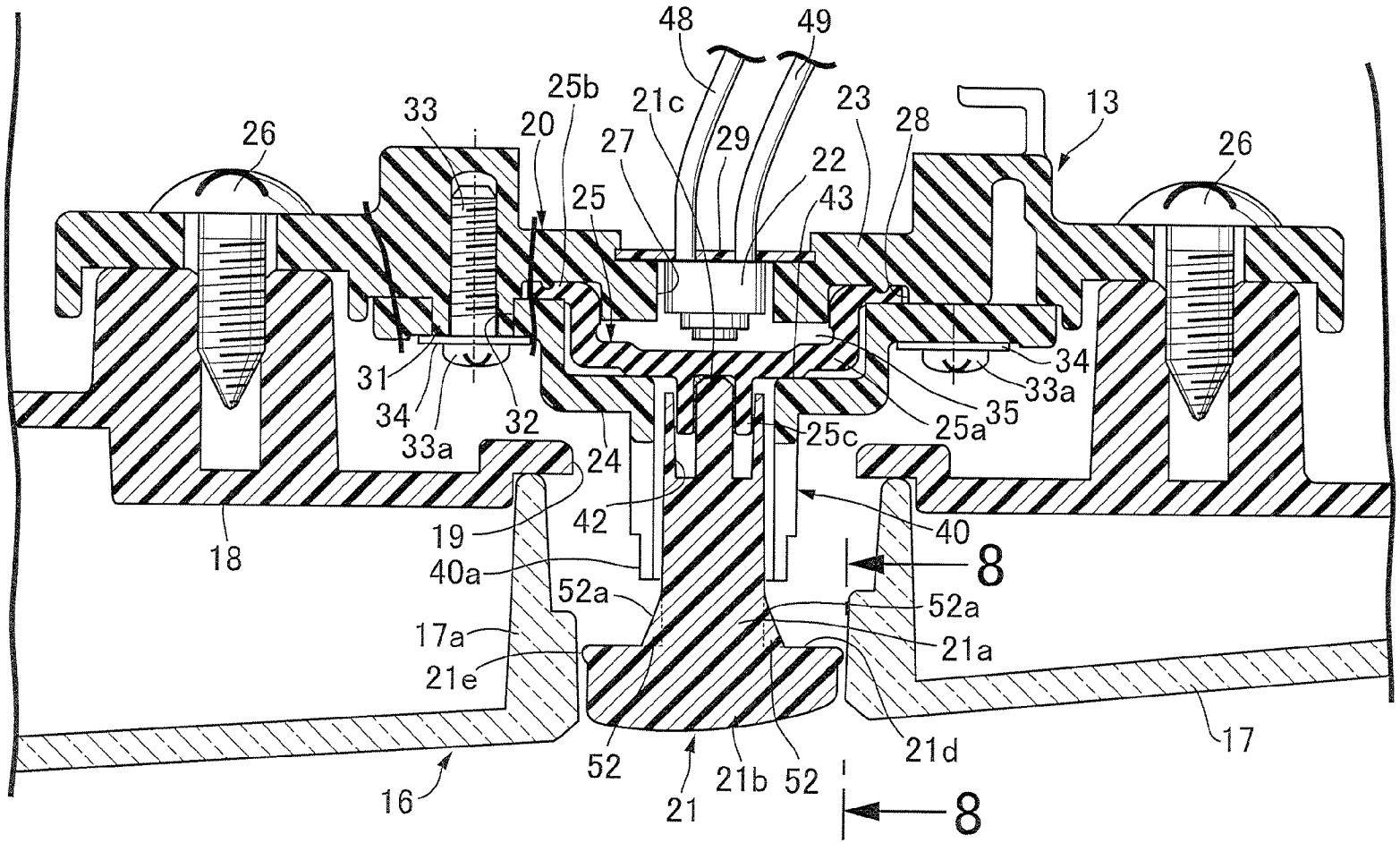
FIG. 4 is a sectional view taken along the line 4-4 in FIG. 2.
Figure 5:
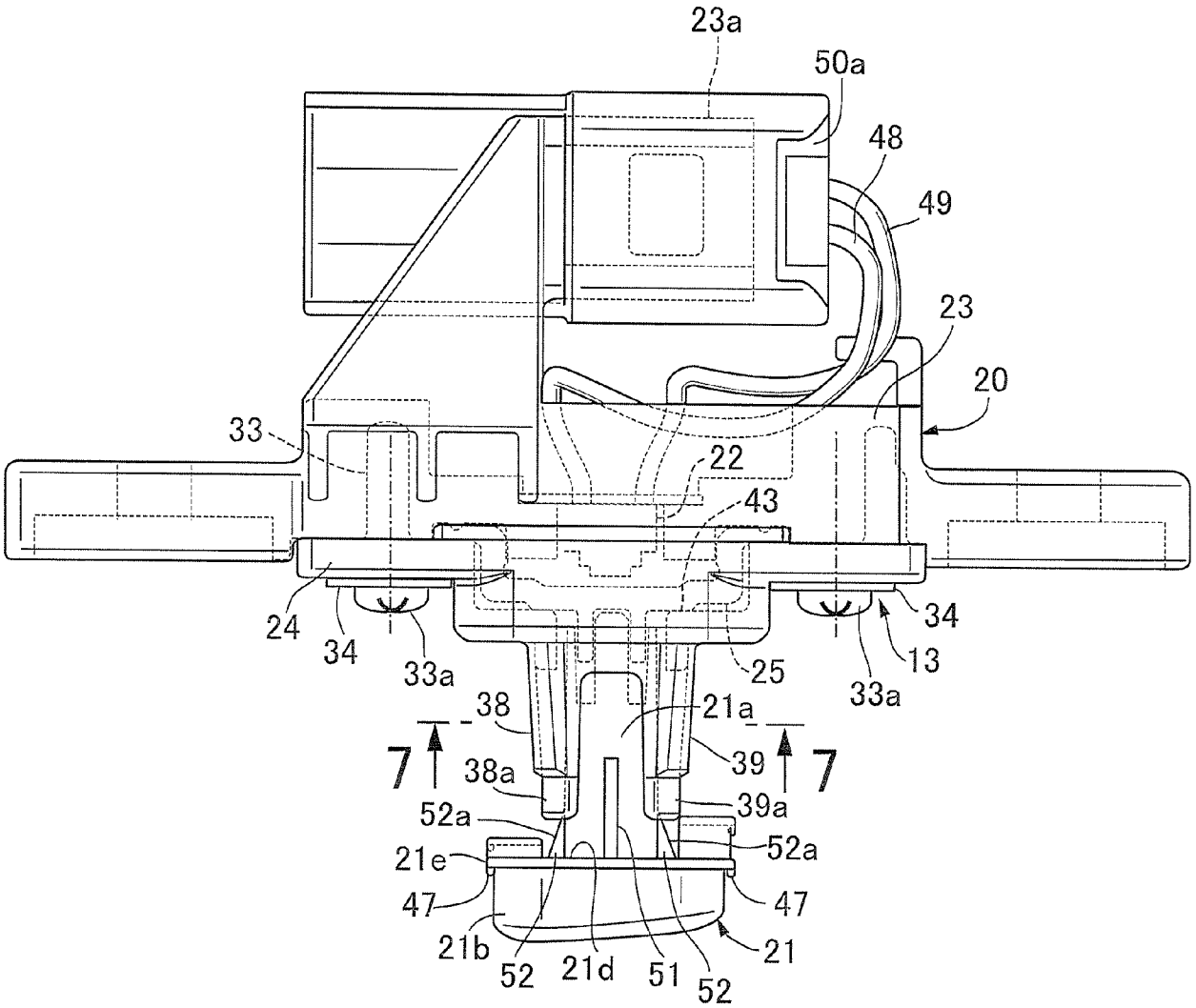
FIG. 5 is a view of a push button switch as viewed in the direction of the arrow 5 in FIG. 3.
Figure 6:
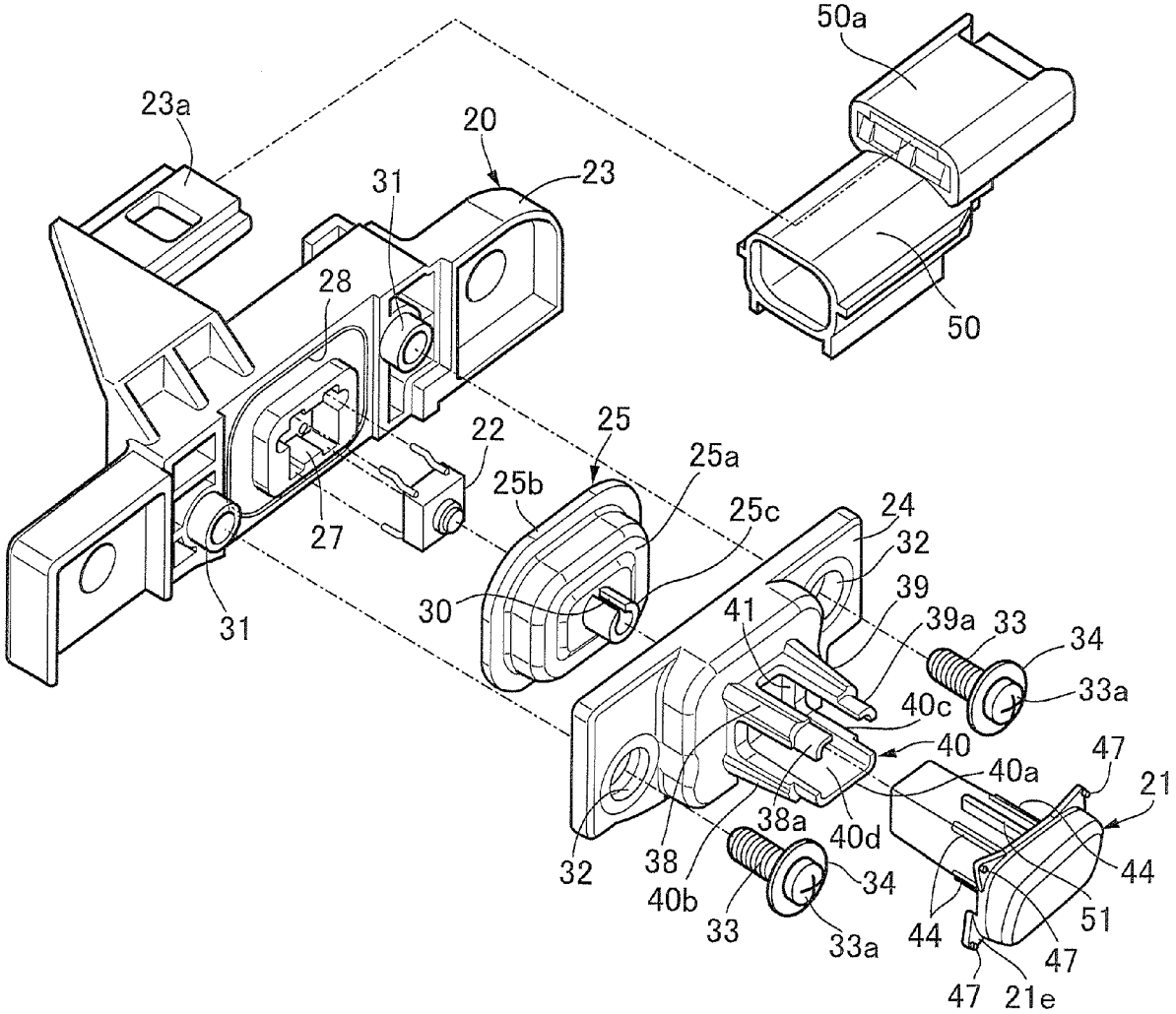
FIG. 6 is an exploded perspective view of the push button switch.

Referring also to FIGS. 4 to 6, the case 20 is formed of: a first case member 23 fixed to the trunk lid 11 and made of a synthetic resin; a second case member 24 fixed to the first case member 23 and made of a synthetic resin; and an elastic member 25 having an entire peripheral edge portion interposed between the first and second case members 23, 24.

The first case member 23 is fixed to the attachment member 18 by, for example, a pair of screw members 26. A switch housing hole 27 is provided in the first case member 23 to correspond to the tube portion 17*a* of the lens 17. A recessed portion 28 surrounding the switch housing hole 27 and being continuous in an endless shape is provided in a rear surface of the first case member 23.

The tact switch 22 is housed in the switch housing hole 27 and is supported by a substrate 29 which is attached to a front surface of the first case member 23 to close a front end of the switch housing hole 27.

The elastic member 25 is made of, for example, rubber and integrally includes: a plate-shaped elastic member main portion 25*a* covering the tact switch 22 from the rear side; a flange portion 25*b* protruding laterally from an open end edge of the elastic member main portion 25*a* to fit into the recessed portion 28; and a connecting tube portion 25*c* protruding rearward from a center portion of the elastic member main portion 25*a*. A slit 30 extending in the longitudinal direction is formed at one position in the connecting tube portion 25*c* in the peripheral direction.

A pair of cylindrical boss portions 31 protruding rearward are provided to protrude from a rear surface of the first case member 23, outside the recessed portion 28. Fitting holes 32 to which the boss portions 31 are fitted are provided in the second case member 24. Enlarged diameter head portions 33*a* of screw members 33 inserted into the boss portions 31 and screwed to the first case member 23 come in contact and engage with a rear surface of the second case member 24 via washers 34 and the second case member 24 is thereby fixed to the first case member 23. In the fixed state, an entire outer peripheral edge portion of the elastic member 25, i.e. the entire flange portion 25*b* is interposed between the first and second case members 23, 24 and the tact switch 22 is housed in a housing chamber 35 formed between the first case member 23 and the elastic member 25.

In the push button 21, a push operation portion 21*b* protruding outward from a linearly-extending bar-shaped portion 21*a* is provided at an outer end of the bar-shaped portion 21*a* in such a way as to be operable by being pushed from the outside of the vehicle. The bar-shaped portion 21*a* is formed such that an outer shape of a horizontal cross section thereof is rectangular.

The second case member 24 includes: multiple, for example three, guide portions of first to third guide portions 38, 39, 40 which are spaced away from each other in the peripheral direction of the bar-shaped portion 21*a* to guide multiple sections of the bar-shaped portion 21*a* in the push button 21 that are located in the peripheral direction; and an opening portion 41 surrounded by the first to third guide portions 38 to 40. The center portion of the elastic member 25 interposed between the first and second case members 23, 24, i.e. the center portion of the elastic member main portion 25*a* is disposed to face the opening portion 41 together with the connecting tube portion 25*c*.

In an inner end of the bar-shaped portion 21*a* in the push button 21, an insertion recessed section 42 to which the connecting tube portion 25*c* of the elastic member 25 is inserted is provided and a connecting shaft portion 21*c* protruding toward the elastic member 25 from a closed end center portion of the insertion recessed section 42 is integrally provided. Inserting the connecting shaft portion 21*c* into the connecting tube portion 25*c* with adhesive provided therebetween causes the push button 21 to be coupled to the elastic member 25, and the tact switch 22 housed in the housing chamber 35 can thereby cause the switching state to change in response to bending of the center portion of the elastic member 25 which occurs with the push operation of the push button 21.

Moreover, a restricting surface 43 restricting expansion of the elastic member 25 by coming in contact with the elastic member 25 is formed in the inner surface of the second case member 24, in the peripheral edge of the opening portion 41, and displacement of the elastic member 25 away from the tact switch 22 is restricted by the restricting surface 43, the elastic member 25 exerting an elastic force biasing the push button 21 in a direction to return the push button 21 to its original position.

Figure 7:
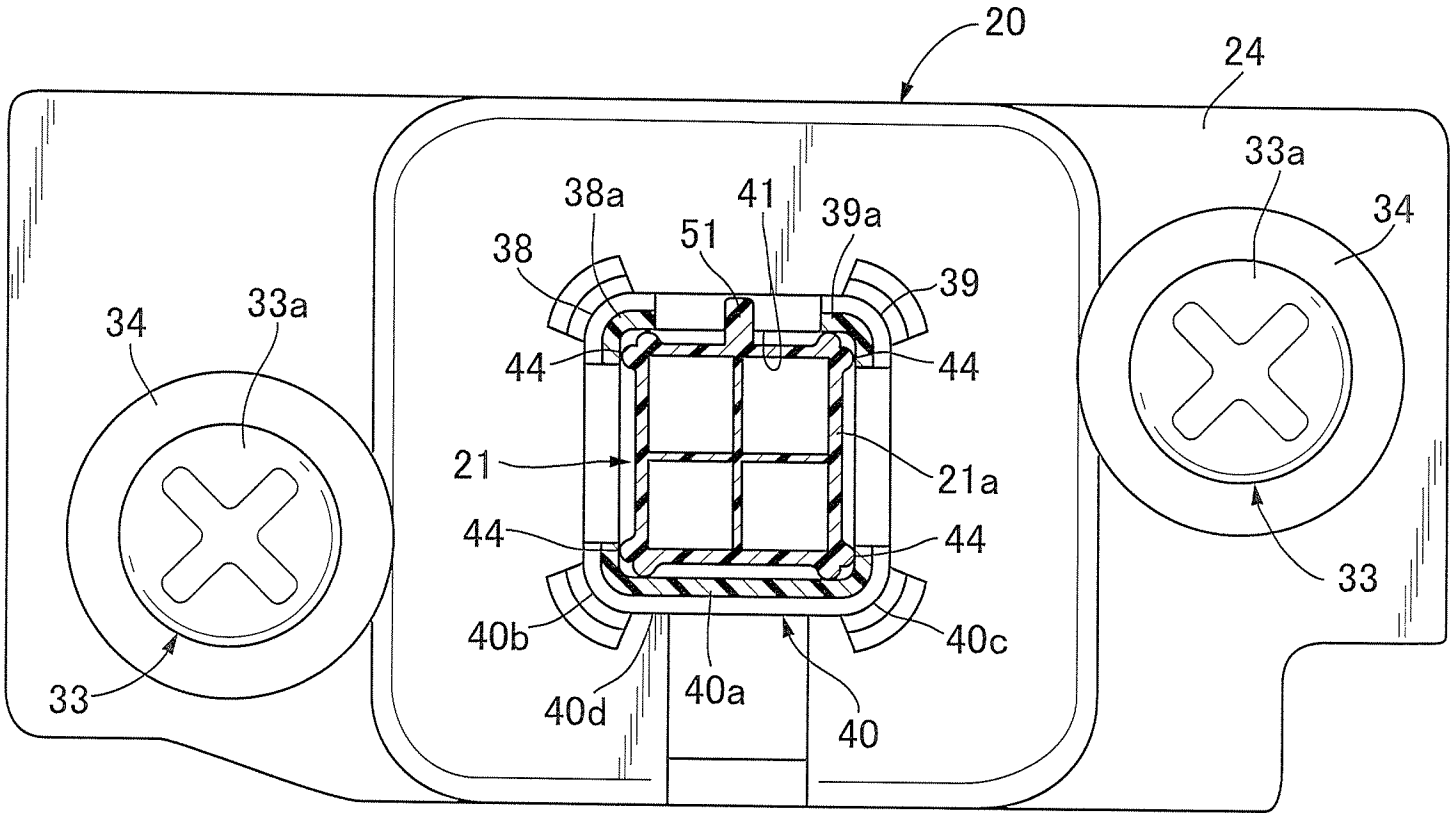
FIG. 7 is a sectional view taken along the line 7-7 in FIG. 5.

Referring also to FIG. 7, the first and second guide portions 38, 39 among the first to third guide portions 38 to 40 correspond respectively to two upper corners of the bar-shaped portion 21*a* whose outer shape of the horizontal cross section is rectangular. The first and second guide portions 38, 39 are each formed to have a substantially L-shaped horizontal cross section and to extend in the longitudinal direction of the bar-shaped portion 21*a*. Moreover, the third guide portion 40 which is remaining one of the guide portions is formed of: two corner guide sections 40*b*, 40*c* corresponding respectively to two lower corners of the bar-shaped portion 21*a* and each having a substantially L-shaped horizontal cross section; and a flat-plate shaped connecting wall section 40*d* connecting the corner guide sections 40*b*, 40*c* to each other.

Moreover, guide ribs 44 coming in sliding contact with inner surfaces of the first guide portion 38, the second guide portion 39, and the two corner guide sections 40*b*, 40*c* of the third guide portion 40 protrude respectively from four corners of outer surfaces of the bar-shaped portion 21*a* whose outer shape of the horizontal cross section is rectangular in the push button 21. Furthermore, the guide ribs 44 are each formed to extend from an end portion on the push operation portion 21*b* side to an intermediate portion of the bar-shaped portion 21*a* in the longitudinal direction thereof.

A step portion 21*d* corresponding to distal ends of the first to third guide portions 38 to 40 is formed between the bar-shaped portion 21*a* and the push operation portion 21*b* of the push button 21 to come in contact with the distal ends of the first to third guide portions 38 to 40 during a deep push operation of the push button 21. Moreover, in distal end portions of the first to third guide portions 38 to 40 formed integrally with the second case member 24 made of the synthetic resin, there are formed thin sections 38*a*, 39*a*, 40*a* thinner than other sections of the guide portions 38 to 40.

Figure 8:
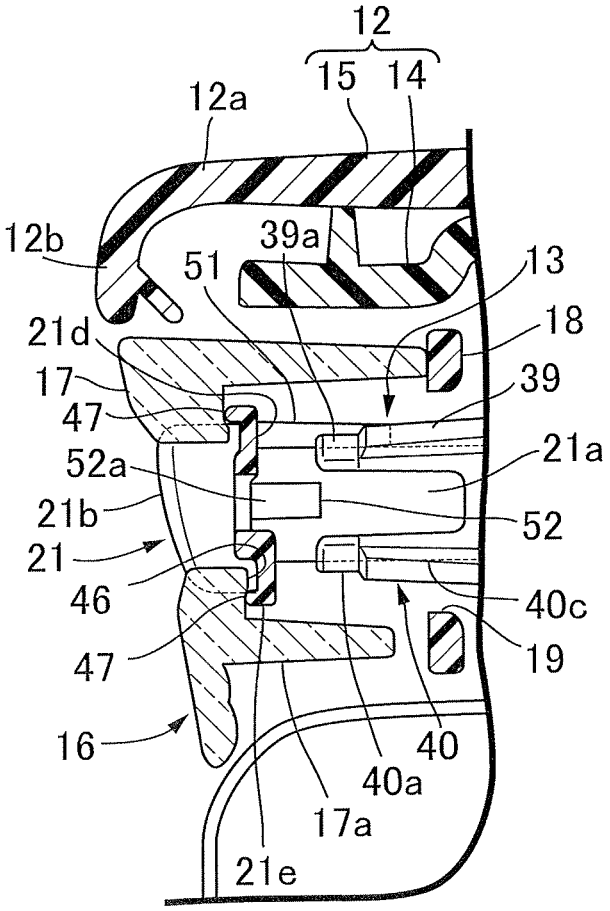
FIG. 8 is a sectional view taken along the line 8-8 in FIG. 4.

Referring also to FIG. 8, a flange portion 21*e* facing a restricting step section 46 from the front side is integrally formed to protrude outward from an outer peripheral edge of the push operation portion 21*b* in the push button 21, the restricting step section 46 facing forward and provided in the tube portion 17*a* formed integrally with the lens 17 of the brake lamp 16. Protrusions 47 coming in point contact with the restricting step section 46 protrude from multiple positions of the flange portion 21*e* which are spaced away from each other in the peripheral direction of the flange portion 21*e*.

The protrusions 47 are provided to avoid full-surface contact of the flange portion 21*e* with the restricting step section 46 in a non-operation state of the push button 21 and there is obtained an effect of preventing a case where water entering a space between the flange portion 21*e* and the restricting step section 46 freezes and the push operation of the push button 21 becomes difficult due to the full-surface contact.

An ice scraping rib 51 disposed at a position corresponding to a region between the first and second guide portions 38, 39 and ice scraping ribs 52 disposed respectively at a position corresponding to a region between the first and third guide portions 38, 40 and a position corresponding to a region between the second and third guide portions 39, 40 protrude from the outer surfaces of the bar-shaped portion 21*a* in the push button 21 to extend forward from the push operation portion 21*b* in the longitudinal direction of the bar-shaped portion 21*a*.

The ice scraping rib 51 disposed to correspond to the region between the first and second guide portions 38, 39 is formed relatively long to be located between the first and second guide portions 38, 39 in the non-operation state of the push button 21, and thereby serves a function of preventing erroneous installation. The positions of the first to third guide portions 38 to 40 relative to the bar-shaped portion 21*a* are set in such a way that the ice scraping rib 51 is determined to be at a certain position relative to the first to third guide portions 38 to 40. Specifically, the outer shape of the horizontal cross section of the bar-shaped portion 21*a* is rectangular, the first to third guide portions 38 to 40 are disposed to guide the guide ribs 44 at the four corners of the bar-shaped portion 21*a*, and the third guide portion 40 is formed to have the connecting wall section 40*d* facing one of the outer surfaces of the bar-shaped portion 21*a* which is on the opposite side to a portion where the ice scraping rib 51 protrudes.

Accordingly, as shown in FIG. 7, the push button 21 can be installed by being pushed and inserted between the first to third guide portions 38 to 40 with the ice scraping rib 51 disposed between the first and second guide portions 38, 39. When the position of the push button 21 relative to the first to third guide portions 38 to 40 is turned 180° from the state shown in FIG. 7, the ice scraping rib 51 comes in contact with the connecting wall section 40*d* of the third guide portion 40 and the push button 21 cannot be thus installed by being pushed and inserted between the first to third guide portions 38 to 40. Moreover, when the position of the push button 21 relative to the first to third guide portions 38 to 40 is turned 90° from the state shown in FIG. 7, the ice scraping rib 51 is located between the first and third guide portions 38, 40 or between the second and third guide portions 39, 40. In this case, since the guide ribs 44 coming in sliding contact with the inner surfaces of the first guide portion 38, the second guide portion 39, and the two corner guide sections 40*b*, 40*c* of the third guide portion 40 protrude from the four corners of the outer surfaces of the bar-shaped portion 21*a* whose outer shape of the horizontal cross section is rectangular, the push button 21 cannot be installed by being pushed and inserted between the first to third guide portions 38 to 40.

The ice scraping rib 51 is formed relatively long to be located between the first and second guide portions 38, 39 in the non-operation state of the push button 21 to serve the function of preventing erroneous installation as described above. However, the ice scraping ribs 52 disposed between the first and third guide portions 38, 40 and between the second and third guide portions 39, 40, respectively, are formed relatively short not to be located between the first and third guide portions 38, 40 and between the second and third guide portions 39, 40 in the non-operation state of the push button 21.

Inclined surfaces 52*a* inclined in such a way that protruding amounts thereof from the bar-shaped portion 21*a* become smaller toward the front side in the moving direction of the push button 21 in the push operation are formed in at least front end portions of the ice scraping ribs 52 in the moving direction, in the embodiment, over the entire length of the ice scraping ribs 52 in the longitudinal direction thereof.

Figure 9B:
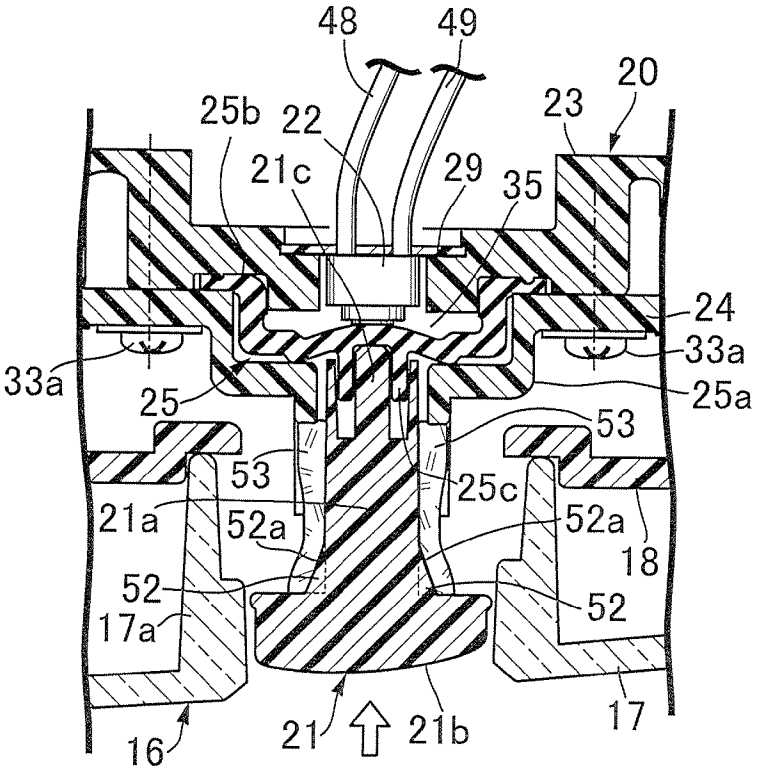
FIGS. 9A and 9B are sectional views for explaining a state where frozen ice portions are scraped away by ice scraping ribs and correspond to part of FIG. 4.
Figure 9A:
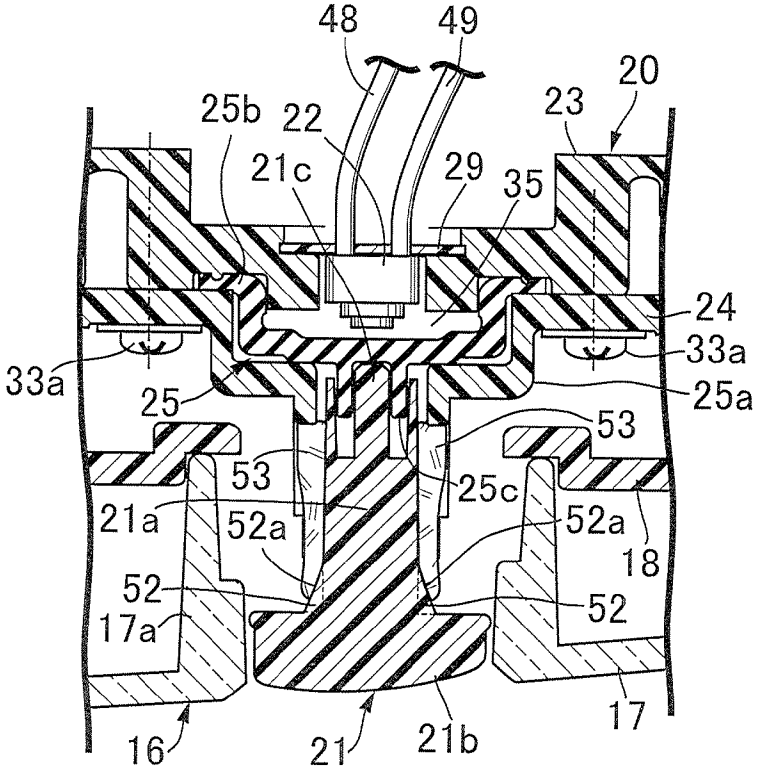

The ice scraping ribs 51, 52 can scrape away frozen ice portions 53 which are formed by freezing of water attached to the outer surfaces of the bar-shaped portion 21*a* between each two of the first guide portion 38, the second guide 39, and the third guide 40 as shown in FIG. 9A, as the bar-shaped portion 21*a* moves with the push operation of the push button 21 as shown in FIG. 9B.

Referring again to FIGS. 3 to 6, a pair of lead wires 48, 49 connected to the tact switch 22 supported by the case 20 are lead out from the substrate 29. A connector 50 to which the lead wires 48, 49 are connected is held by a plate-shaped connector holding portion 23*a* provided integrally with the first case member 23. Specifically, a tubular supported portion 50*a* is integrally formed in the connector 50 and the connector 50 is held by the connector holding portion 23*a* by inserting the connector holding portion 23*a* into the supported portion 50*a*.

Next, operations of the embodiment are described. The first to third guide portions 38 to 40 for guiding the linear movement of the push button 21 operable by being pushed from the outside of the vehicle are provided in the case 20 fixed to the trunk lid 11 while the tact switch 22 for causing the switching state to change in response to the push operation of the push button 21 is supported by the case 20, the case 20 is formed of: the first case member 23 fixed to the trunk lid 11; the second case member 24 fixed to the first case member 23 and having the first to third guide portions 38 to 40 and the opening portion 41 surrounded by the first to third guide portions 38 to 40; and the elastic member 25 having the entire peripheral edge portion interposed between the first and second case members 23, 24 with the center portion of the elastic member 25 facing the opening portion 41, the push button 21 is coupled to the center portion of the elastic member 25, and the tact switch 22 housed in the housing chamber 35 formed between the first case member 23 and the elastic member 25 is supported by the first case member 23 such that the switching state changes in response to bending of the center portion of the elastic member 25 which occurs with the push operation of the push button 21. Accordingly, a sealing structure protecting the tact switch 22 can be obtained in a simple structure in which an increase in the number of parts is avoided.

Moreover, the restricting surface 43 restricting expansion of the elastic member 25 by coming in contact with the elastic member 25 is formed in the inner surface of the second case member 24, in the periphery of the opening portion 41. Accordingly, the thermal expansion of the elastic member 25 is suppressed even when the elastic member 25 thermally expands due to temperature rise and the like, and it is thus possible to suppress variation in an operation stroke of the push button 21 and improve operability.

Furthermore, in the push button 21, the push operation portion 21*b* is provided at the outer end of the bar-shaped portion 21*a* linearly extending to be guided by the first to third guide portions 38 to 40, in such a way as to be operable by being pushed from the outside of the vehicle, the first to third guide portions 38 to 40 are spaced away from each other in the peripheral direction of the bar-shaped portion 21*a* to guide multiple sections of the bar-shaped portion 21*a* that are located in the peripheral direction, and the multiple long guide ribs 44 extending in the longitudinal direction of the bar-shaped portion 21*a* to come in sliding contact with the inner surfaces of the first to third guide portions 38 to 40 protrude from the outer surfaces of the bar-shaped portion 21*a*. Accordingly, a work of inserting the push button 21 between the first to third guide portions 38 to 40 is facilitated and an installation work of the push button 21 is thus facilitated.

Moreover, the guide ribs 44 are formed to extend from the end portion on the push operation portion 21*b* side to the intermediate portion of the bar-shaped portion 21*a* in the longitudinal direction thereof. Accordingly, the guide ribs 44 do not come into sliding contact with the first to third guide portions 38 to 40 at the start of insertion of the push button 21 between the first to third guide portions 38 to 40 and the insertion of the push button 21 between the first to third guide portions 38 to 40 is thereby facilitated.

Furthermore, the step portion 21*d* corresponding to distal ends of the first to third guide portions 38 to 40 is formed between the bar-shaped portion 21*a* and the push operation portion 21*b* of the push button 21 to come in contact with the distal ends of the first to third guide portions 38 to 40 during the deep push operation of the push button 21. Accordingly, the deep push of the push button 21 can be restricted while the number of parts is reduced and the structure is simplified by providing no dedicated restricting portion.

Moreover, in the distal end portions of the first to third guide portions 38 to 40 formed integrally with the second case member 24 made of the synthetic resin, there are formed the thin sections 38*a*, 39*a*, 40*a* thinner than other sections of the distal end portions of the guide portions 38 to 40. Accordingly, when the step portion 21*d* of the push button 21 comes into contact with the distal ends of the first to third guide portions 38 to 40, the distal end portions of the first to third guide portions 38 to 40 can be bent to reduce a load applied to the push button 21.

Furthermore, the ice scraping rib 51 disposed at the position corresponding to the region between the first and second guide portions 38, 39 and the ice scraping ribs 52 disposed at the position corresponding to the region between the first and third guide portions 38, 40 and at the position corresponding to the region between the second and third guide portions 39, 40, respectively, protrude from the outer surfaces of the bar-shaped portion 21*a* in the push button 21 in such a way as to be capable of scraping away the frozen ice portions 53 which are formed by freezing of water attached to the outer surfaces of the bar-shaped portion 21*a* between the first and second guide portions 38, 39, between the first and third guide portions 38, 40, and between the second and third guide portions 39, 40 as the bar-shaped portion 21*a* moves with the push operation of the push button 21. Accordingly, the push operation of the push button 21 is not hindered even when the frozen ice portions 53 are formed on the outer surfaces of the bar-shaped portion 21*a*.

Moreover, inclined surfaces 52*a* inclined in such a way that protruding amounts thereof from the bar-shaped portion 21*a* become smaller toward the front side in the moving direction of the push button 21 in the push operation are formed in at least front end portions of the ice scraping ribs 52 in the moving direction, in the embodiment, over the entire length of the ice scraping ribs 52 in the longitudinal direction thereof. Accordingly, the frozen ice portions 53 can be more effectively scraped away.

Furthermore, the ice scraping rib 51 serves the function of preventing erroneous installation and the positions of the first to third guide portions 38 to 40 relative to the bar-shaped portion 21*a* are set in such a way that the ice scraping rib 51 is determined to be at a certain position relative to the first to third guide portions 38 to 40. Accordingly, the erroneous installation of the push button 21 can be surely prevented.

The embodiment of the present invention has been described above. However, the present invention is not limited to the aforementioned embodiment and various design changes can be made without departing from the invention described in the claims.

For example, in the aforementioned embodiment, a description is given of the case where the case 20 is supported by the trunk lid 11. However, the present invention can be applied to a configuration in which the case is supported by a lid other than the trunk lid 11 and to a configuration in which the case is supported by a vehicle body openably and closably supporting the lid.

What is claimed is:

1. A vehicle push button switch comprising:

a push button including a linearly-extending bar-shaped portion and a push operation portion which is provided at an outer end of the bar-shaped portion to protrude outward from the bar-shaped portion and to be operable by being pushed from outside of a vehicle;

a case fixed to a vehicle body or a lid openably and closably attached to the vehicle body, the case having a guide portion for guiding a linear movement of the push button; and a switch housed in the case such that a switching state of the switch is changed in response to a push operation of the push button, wherein as said guide portion, the case is provided with a plurality of guide portions spaced away from each other in a peripheral direction of the bar-shaped portion to guide a plurality of sections of the bar-shaped portion that are located in the peripheral direction, and an ice scraping rib protrudes from an outer surface of the bar-shaped portion, the ice scraping rib capable of scraping away a frozen ice portion, which is formed by freezing of water attached to the outer surface of the bar-shaped portion between the plurality of guide portions, in response to movement of the bar-shaped portion following the push operation of the push button.

2. The vehicle push button switch according to claim 1, wherein an inclined surface is formed at least in a front end portion of the ice scraping rib in a moving direction of the push button in the push operation, the inclined surface being inclined in such a way that a protruding amount thereof from the bar-shaped portion becomes smaller toward a front side in the moving direction.

3. The vehicle push button switch according to claim 1, wherein the bar-shaped portion of the push button includes more than one said ice scraping rib protruding from the sections of the bar-shaped portion and having different shapes.

4. The vehicle push button switch according to claim 3, wherein said ice scraping ribs as provided on the sections of the bar-shaped portion are shaped to align with the guide portions in a specific manner for assuring proper installation of the push button to the case.

5. The vehicle push button switch according to claim 1, further comprising an elastic member which is disposed in the case in covering relation to the switch, and the elastic member is moved into contact with the switch by the bar-shaped portion when the push button is pushed.

6. The vehicle push button switch according to claim 1, wherein said bar-shaped portion slides relative to the guide portions of said case when the push button is pushed.

7. A vehicle push button switch comprising:

a push button including a linearly-extending bar-shaped portion and a push operation portion which is provided at an outer end of the bar-shaped portion to protrude outwardly of the vehicle from the bar-shaped portion and to be operable by being pushed in a linear direction from outside of a vehicle;

a case fixed to a vehicle body or a lid openably and closably attached to the vehicle body, the case having a guide portion for guiding a linear movement of the push button; and a switch housed in the case such that a switching state of the switch is changed in response to a push operation of the push button, wherein as said guide portion includes a plurality of guide sections spaced away from each other in a peripheral direction of the bar-shaped portion to guide a plurality of sections of the bar-shaped portion that are located in the peripheral direction as said button is pushed in the linear direction, and the bar-shaped portion includes an ice scraping rib which protrudes from an outer surface of the bar-shaped portion, the ice scraping rib is configured to scrap away ice, which is formed by freezing of water attached to the outer surface of the bar-shaped portion between the plurality of guide sections, in response to linear movement of the bar-shaped portion when the push button is pushed.

8. The vehicle push button switch according to claim 7, wherein an inclined surface is formed at least in a front end portion of the ice scraping rib in the linear moving direction when the push button is pushed, the inclined surface is inclined such that a protruding amount thereof from the bar-shaped portion becomes smaller toward a front side in the linear moving direction.

9. The vehicle push button switch according to claim 7, wherein the bar-shaped portion of the push button includes more than one said ice scraping rib protruding from the sections of the bar-shaped portion and having different shapes.

10. The vehicle push button switch according to claim 9, wherein said ice scraping ribs as provided on the sections of the bar-shaped portion are shaped to align with the guide portions in a specific manner for assuring proper installation of the push button to the case.

11. The vehicle push button switch according to claim 7, further comprising an elastic member which is disposed in the case in covering relation to the switch, and the elastic member is moved into contact with the switch by the bar-shaped portion when the push button is pushed.

12. The vehicle push button switch according to claim 7, wherein said bar-shaped portion slides relative to the guide portions of said case when the push button is pushed.

* * * * *